United States Patent [19]

Eberly, Jr.

[11] 3,985,644

[45] Oct. 12, 1976

[54] USE OF WATER/METHANOL MIXTURES AS SOLVENTS FOR AROMATICS EXTRACTION

[75] Inventor: Paul Earl Eberly, Jr., Baton Rouge, La.

[73] Assignee: Exxon Research and Engineering Company, Linden, N.J.

[22] Filed: Jan. 30, 1975

[21] Appl. No.: 545,372

[52] U.S. Cl. ..... 208/321; 208/324; 208/333; 260/674 SE

[51] Int. Cl.[2] ..... C10G 21/16

[58] Field of Search ..... 208/324, 333, 321; 260/674 SE

[56] References Cited

UNITED STATES PATENTS

| | | | |
|---|---|---|---|
| 1,783,203 | 12/1930 | Werkenthin | 208/333 |
| 2,288,853 | 7/1942 | Sowers | 208/324 |
| 2,656,301 | 10/1953 | Findlay | 208/324 |
| 2,838,582 | 6/1958 | Kassel et al. | 208/324 |
| 3,079,326 | 2/1963 | Neuworth | 208/333 |

*Primary Examiner*—Herbert Levine
*Attorney, Agent, or Firm*—J. Simon

[57] ABSTRACT

Petroleum fractions may be separated into aromatic-rich and paraffinic-rich hydrocarbon streams by the use of methanol/water mixtures having more than 20% water. The paraffinic-rich stream is recovered as raffinate. The aromatic-rich stream passes out of the extraction zone and is recovered by lowering the temperature to induce a phase separation.

10 Claims, 2 Drawing Figures

USE OF WATER/METHANOL MIXTURES AS SOLVENTS FOR AROMATICS EXTRACTION

BACKGROUND OF THE INVENTION

This invention relates to a process for solvent refining of petroleum. Numerous solvents have been used to separate aromatic and paraffinic constituents in hydrocarbon streams. Such separation is desirable because the aromatic constituents in gasoline fractions contribute toward high octane numbers, while the straight chain paraffinic constituents greatly reduce octane numbers. Furthermore, pure benezene, toluene and xylenes are important raw materials in the petrochemical industry. Paraffinic hydrocarbon streams are used as constituents of heating oils and jet fuel.

The solvents used in such extraction processes must meet critical requirements of (1) being only partially miscible with the hydrocarbon feed stream (2) having a high hydrocarbon extraction capacity and (3) having a high selectivity for aromatic hydrocarbons. High capacity is important since this reduces the amount of solvent necessary to achieve the desired separation and thereby reduces the size of the vessels and associated pumps needed for recirculation. Selectivity ($\beta$), is also important. This is defined as $$\beta = \frac{\text{(\% arom./nonarom.) in Extract Phase}}{\text{(\% arom./nonarom.) in Raffinate Phase}}$$

Solvents having a high selectivity require fewer stages of extraction to achieve a given degree of separation. This, in effect, reduces the height of the extraction vessel. Generally speaking, the higher the capacity of the solvent the lower the selectivity. Therefrom some compromise is generally made between these properties in selecting a suitable solvent for the separation desired.

Other desirable characteristics of a good extraction solvent include the following: (4) low molecular weight; (5) non-corrosiveness to the equipment at operating conditions; (6) complete stability under operating conditions; (7) easy recoverability from the hydrocarbon products; and (8) low cost.

No extraction solvent has yet been discovered which satisfies all of the foregoing requirements for the separation of paraffinics and aromatics in hydrocarbon streams. A number of solvents have been used including sulfolane, N-formyl morpholine, various glycols and mixtures thereof, etc. The use of most of these solvents requires, subsequent to the extraction step, that either the solvent or the hydrocarbon be removed from the aromatic-rich solvent phase by distillation. This requires a large amount of heat which is a major cost item in the extraction process.

There is great incentive in seeking an extraction solvent which would be lower in cost than those heretofore used commercially. Furthermore, there is additional incentive in seeking a solvent which can be separated from the aromatic-solvent phase without the necessity of distillation. This invention provides a solvent meeting these requirements. The use of said solvent results in a process for separation of aromatic and paraffinic hydrocarbons which is economically attractive in that the solvent is quite inexpensive and can be separated from the aromatic-rich phase by simple lowering of temperature, rather than by distillation.

SUMMARY OF THE INVENTION

An aromatics-containing petroleum fraction is separated into aromatic-rich and paraffinic-rich hydrocarbon streams by using, as an extraction solvent, a mixture of methanol and water in which the water comprises at least 20% by volume. The temperature in the extraction zone is between about 150° and 400° F. The aromatic hydrocarbons are dissolved in the solvent and, upon separation from the paraffinic-rich raffinate stream, the solvent phase is passed to a settling zone where the temperature is lowered. The lowering of the temperature causes separation of the aromatic-rich hydrocarbon stream and the solvent stream, the solvent stream being recycled to the extraction zone.

DESCRIPTION OF THE DRAWINGS

In the accompanying drawings.

PRIOR ART

Figure 1:
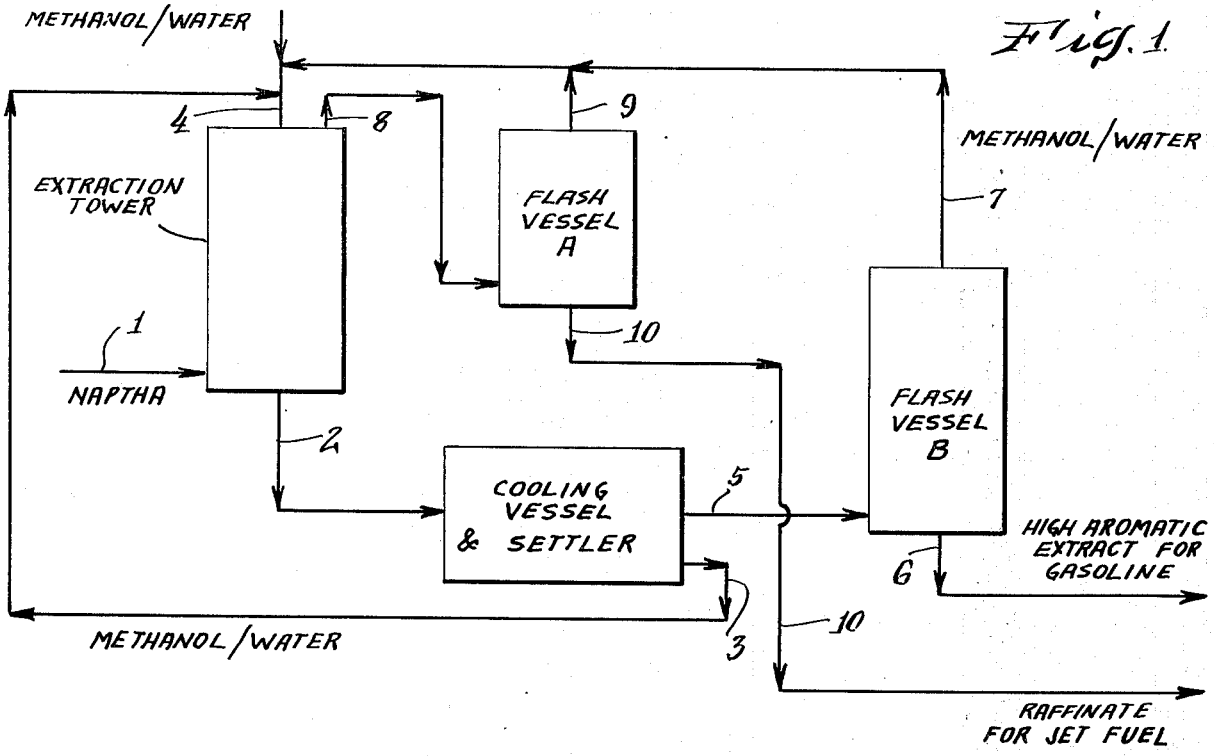
FIG. 1 is a flow diagram showing the separation of a catalytic naphtha by a process according to this invention into an aromatic-rich extract for use in, for example, gasoline and a paraffinic-rich raffinate for use in, for example, jet fuel.

The use of low molecular weight aliphatic alcohols as extraction solvents is well known in the art. For example, U.S. Pat. Nos. 1,781,421 and 1,783,203 disclose the use of substantially anhydrous alcohols for this purpose. U.S. Pat. No. 2,770,663 discloses that water and aliphatic alcohols can be admixed for use in solvent extraction; the specific aliphatic alcohols illustrated, however, are glycols, rather than monohydric alcohols.

U.S. Pat. No. 3,119,767 discloses a method of separating aromatic and paraffinic constituents in hydrocarbon mixtures by the use of mixtures of methanol and water or ethanol and water. The volume of water in these mixtures, however, is limited to 5%. As indicated therein, extraction with the use of these solvents requires subsequent distillation of the aromatic-rich solvent phase in order to recover the solvent.

DETAILED DISCLOSURE

This invention provides for the separation of a petroleum hydrocarbon fraction into a paraffinic-rich raffinate phase and an aromatic-rich solvent phase by contacting the petroleum fraction with a methanol/water solvent in which water comprises at least about 20 vol. %.

The hydrocarbon feed may be any petroleum hydrocarbon fraction containing aromatics, such as, for example, naphthas (virgin or cracked), kerosene, gasoline, heating oils, lubricating oils, and residua. The boiling point of said feeds may range from about 180°F, for naphtha, up to and including the boiling ranges of vacuum residua. Preferably, the feedstream is a hydrocarbon distillate, particularly an atmospheric distillate or a lube oil fraction. More preferably, the feedstream is a light atmospheric distillate such as a naphtha, kerosene or Diesel fuel. The methanol/water solvent must comprise at least 20% by volume of water. Preferably, said solvent comprises from about 22% to about 40% by volume of water.

The hydrocarbon fraction is contacted with solvent in an extraction zone at a temperature of between about 150° to about 400° F, preferably from about 200° to about 350° F, most preferably about 300° F. The solvent to oil volume ratio is preferably from about 0.5 to about 5.

The hydrocabon stream is separated into a paraffinic-rich raffinate phase and an aromatic-rich solvent phase. The raffinate phase is passed overhead out of the extraction zone and the paraffinic-rich product is recovered. Prior to such recovery, this phase may be passed to a flashing zone where any residual methanol/water solvent is removed and recycled to the extraction zone. The aromatic-rich solvent phase is passed from the extraction zone to a settling and cooling zone. Temperatures in the cooling zone are lowered to below about 150° F, preferably to between about 65° and about 90° F, for example, a temperature of about 75° F. At this lower temperature, the aromatic-rich hydrocarbon layer separates out and can be easily recovered by, for example, decantation. Methanol/water solvent is recycled back to the extraction zone. The aromatic-rich hydrocarbon layer may then optionally be passed to a flashing zone where any residual solvent is removed for recycling to the extraction zone.

The process will be more readily understood by reference to FIG. 1 of the drawing, which is a flow diagram showing the extraction of a catalytic naphtha by a methanol/water mixture having 25 vol.% water at a temperature of 300° F. The catalytic naphtha enters the extraction tower via line 1 where it is contacted with the methanol/water mixture entering via line 4. The heavier aromatic-rich solvent phase is passed via line 2 to a cooling vessel, which also serves as a settler. Here, the stream is cooled to 75° F, causing separation of an aromatic-rich hydrocarbon phase and a solvent phase. The solvent phase, which is nearly pure, is recycled via lines 3 and 4 back to the extractor. The aromatic-rich hydrocarbon phase from the settler is passed via line 5 to flash vessel B where any trace amounts of water and methanol solvent are flashed off and recycled via lines 7 and 4 to the extractor. The bottoms stream from flash vessel B is an aromatic-rich hydrocarbon extract suitable as a blending component in, for example, gasoline. The raffinate phase from the extractor is passed via line 8 to flash vessel A in which any residual alcohol and water solvents are removed and recycled to the extractor via lines 9 and 4. The raffinate, a paraffinic-rich stream, exits from the flash vessel via line 10 and is suitable, for example, as a blend in jet fuel. Alternatively, this stream can be recycled to a reformer for further conversion of paraffins into aromatic hydrocarbons.

Figure 2:
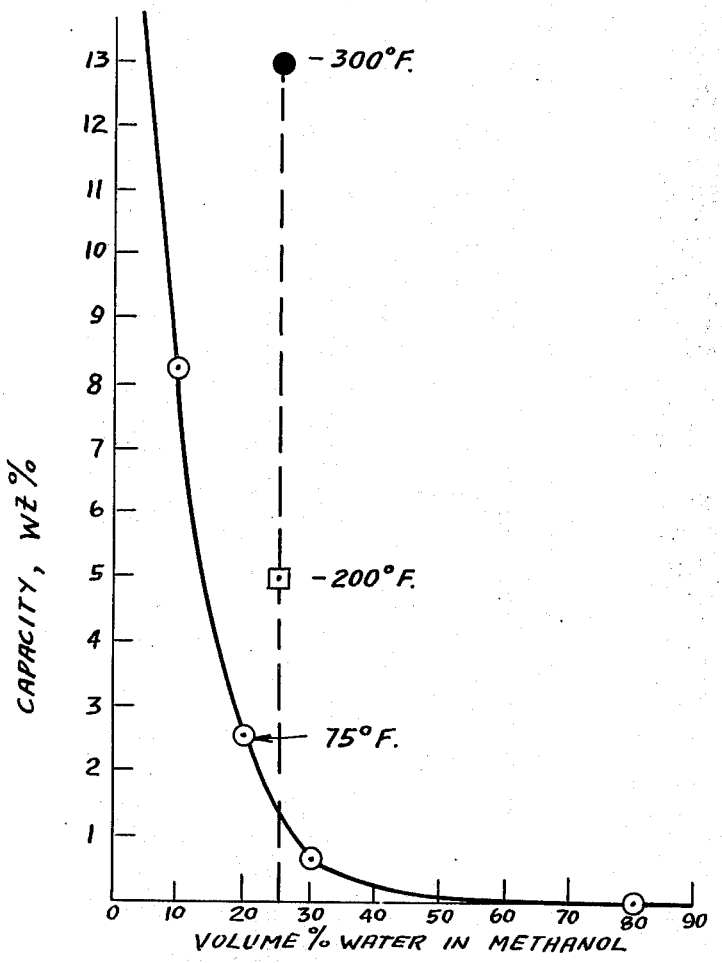
FIG. 2 is a graph showing the capacity of various methanol/water mixturs for the hydrocarbons contained in catalytic naphtha. Both of these drawings will be discussed further below in the detailed disclosure of the invention.

FIG. 2 is a graph showing the capacity of alcohol/water mixturs for hydrocarbons contained in catalytic naphtha boiling in the 300°–400° F range. The capacity is plotted as a function of the vol.% of water in methanol. Below about 20 vol.% of water, the hydrocarbon capacity at room temperature (75° F) is too high, as indicated by the point in the graph showing that at 19% water in methanol, the capacity at 75° F is about 2.5%. By selecting a mixture of 25 vol.% water in methanol, the capacity at 75° F is only about 1.3%. For the same solvent mixture, the capacity at 300° F. is 13.0%. Therefore, using this solvent mixture, and lowering the temperature from 300° F to 75° F, nearly all of the hydrocarbon can be recovered from the solvent phase.

An additional aid to better understanding of this invention is the following example which is included here for the purpose of illustration only and is not intended as a limitation.

EXAMPLE

Data were obtained for methanol/water extraction of catalytic naphtha boiling in the range of between about 300° and about 430° F. The data are shown in the following Table:

TABLE $H_2O/CH_3OH$ Extraction Experiments with 300° – 430°F Cat Naphtha

Feed Density = 0.830 g./ml.; Solvent/Oil Volume Ratio = 2

| | | | |
|---|---|---|---|
| Solvent, Vol. $H_2O$ in $CH_3OH$ | 20 | 25 | 25 |
| Temperature, °F | 75 | 200 | 300 |
| Hydrocarbon Solubility in Solvent, Wt.% | 2.54 | 5.00 | 13.0 |
| Composition of Extract, Mol % | | | |
| Aromatics | 90.2 | 87.0 | 79.6 |
| Olefins | 9.8 | 9.1 | 12.3 |
| Paraffins | 0.0 | 1.7 | 3.6 |
| Cycloparaffins | 0.0 | 1.6 | 2.9 |
| Condensed Naphthenes | 0.0 | 0.7 | 1.6 |
| Composition of Raffinate, Mol % | | | |
| Aromatics | 65.4 | 59.4 | 57.4 |
| Olefins | 17.6 | 18.1 | 18.8 |
| Paraffins | 8.5 | 12.2 | 13.1 |
| Cycloparaffins | 5.6 | {10.2 | {10.7 |
| Condensed Naphthenes | 2.9 | | |
| Selectivity, $\beta$ | 4.85 | 4.56 | 2.85 |

The selectivity, $\beta$, is defined according to the formula $$\beta = \frac{(\%\ \text{Arom.}/\%\ \text{Nonarom.})\ \text{in Extract Phase}}{(\%\ \text{Arom.}/\%\ \text{Nonarom.})\ \text{in Raffinate Phase}}$$

These results show that high capacity and excellent selectivity can be achieved using an extremely inexpensive solvent system and a subsequent separation of solvent from aromatic-rich product by the simple device of lowering temperature. For example, at 300° F, the capacity is 13.0% by weight. At 75° F, the capacity is lowered to about 2.4% by weight thereby springing the hydrocarbon from the solvent and permitting the separation of the hydrocarbon from the solvent.

What is claimed is:

1. A process for the separation of aromatic and paraffinic hydrocarbon constituents of an aromatics-containing petroleum distillate selected from the group consisting of kerosene, naphtha, diesel fuel and mixtures thereof which comprises the steps of (1) introducing at a temperature of from about 150° to about 400° F. the petroleum distillate into an extraction zone containing a methanol/water solvent having at least 20 vol.% of water to obtain an aromatic-rich solvent phase and a paraffinic-rich raffinate phase, (2) passing the solvent phase to a cooling and settling zone where the temperature is lowered to below 150° F., thereby separating an aromatic-rich hydrocarbon stream and a solvent stream, (3) recycling the solvent stream to the extraction zone, and (4) recovering as products a paraffinic-rich hydrocarbon stream and an aromatic-rich hydrocarbon stream.

2. A process according to claim 1 wherein the petroleum distillate is a catalytic naphtha.

3. A process according to claim 1, in which, in step (1), the solvent to oil volume ratio is from about 0.5 to about 5.

4. A process according to claim 1 wherein, in step (1), the extraction temperature is between about 200° and about 350° F.

5. A process according to claim 1 in which the methanol/water solvent contains from about 22 to about 40 vol.% of water.

6. A process according to claim 5 in which the methanol/water solvent contains about 25 vol.% of water.

7. A process according to claim 6 in which, in step (2), the temperature is lowered to between about 65° and about 90° F.

8. A process according to claim 7 in which the temperature is lowered to about 75° F.

9. A process according to claim 1 in which the paraffinic hydrocarbon phase obtained in step (1) and the aromatic-rich hydrocarbon phase obtained in step (2) are separately passed to flashing zones where any residual methanol/water solvent is removed for recycling to the extraction zone.

10. A process for the separation of aromatic and paraffinic hydrocarbon constituents of a catalytic naphtha petroleum fraction which comprises the steps of (1) introducing at a temperature of about 300° F the petroleum fraction into an extraction zone containing a methanol/water solvent having about 25 vol.% water to obtain an aromatic-rich solvent phase and a paraffinic-rich raffinate phase, (2) passing the solvent phase to a cooling and settling zone where the temperature is lowered to about 75° F thereby separating an aromatic-rich hydrocarbon stream and a solvent stream, (3) recycling the solvent stream to the extraction zone, (4) separately passing the paraffinic-rich hydrocarbon phase obtained in step (1) and the aromatic-rich hydrocarbon stream obtained in step (2) to flashing zones where residual methanol/water solvent is removed for recycling to the extraction zone, and (5) recovering as products a paraffinic-rich hydrocarbon stream and an aromatic-rich hydrocarbon stream.

* * * * *